US005794817A

United States Patent [19]

Rosa

[11] Patent Number: 5,794,817

[45] Date of Patent: Aug. 18, 1998

[54] ARTICLE DISPENSER

[76] Inventor: Vincent Rosa, 86-27 86th St., Woodhaven, N.Y. 11421

[21] Appl. No.: 599,225

[22] Filed: Feb. 9, 1996

[51] Int. Cl.[6] ..... B65G 59/00

[52] U.S. Cl. ..... 221/281; 221/311; 193/47; 312/42; 211/49.1

[58] Field of Search ..... 221/281, 311, 221/303, 131, 194, 191, 172; 211/59.2, 49.1; 312/42, 50, 60; 193/47; 198/400

[56] References Cited

U.S. PATENT DOCUMENTS

| | | | |
|---|---|---|---|
| 1,658,428 | 2/1928 | Charles | 198/400 |
| 1,913,403 | 10/1933 | Conner | 312/42 |
| 1,986,101 | 1/1935 | Brodsky | 229/17 |
| 2,915,165 | 12/1959 | Bell | 193/47 |
| 3,306,688 | 2/1967 | Domenico | 211/59.2 |
| 3,502,382 | 3/1970 | Rainey | 312/42 |
| 3,584,727 | 6/1971 | Froehiking | 198/400 |
| 4,037,756 | 7/1977 | Jaquish | 221/242 |
| 4,769,573 | 9/1988 | Celik | 312/60 |
| 4,881,787 | 11/1989 | King | 312/42 |
| 5,131,563 | 7/1992 | Yablans | 221/92 |
| 5,295,592 | 3/1994 | Thorne | 211/59.2 |
| 5,368,191 | 11/1994 | Johnson | 221/194 |

FOREIGN PATENT DOCUMENTS

| | | | |
|---|---|---|---|
| 2144812 | 3/1973 | Germany | A47F 1/08 |
| 0622635 | 7/1978 | U.S.S.R. | 193/47 |
| 1015712 | 1/1966 | United Kingdom | 221/172 |

*Primary Examiner*—H. Grant Skaggs
*Attorney, Agent, or Firm*—Nolte, Nolte and Hunter, P.C.

[57] ABSTRACT

An article is inserted through the upper front of a dispenser, over a first shelf, a fall space, and a second shelf while it is supported by the first shelf at about the same height as the second shelf. The item is then moved off the first shelf so that it pivots on the second shelf and moves down between the shelves. It is caught by one end on a flexible portion of a downward and forward sloping curvilinear wall having a longitudinal access slot through the wall, and supported at the lower part of the dispenser, forward of the front of the dispenser.

17 Claims, 6 Drawing Sheets

ARTICLE DISPENSER

BACKGROUND OF THE INVENTION

1. Field of the Invention

This invention pertains to dispensers which store, display, and dispense articles. More particularly it pertains to a dispenser which receives a plurality of articles of about the same size one by one at the top of a rack, orients, stacks, and delivers the articles one by one at the bottom of the rack, displaying one end of each article in storage and at the delivery point.

2. Description of the Prior Art

The prior art is replete with patents for dispensers designed to display, store, and dispense articles.

For example, U.S. Pat. No. 4,037,756 patented Jul. 26, 1977 by J. Jaquish, describes a vertical housing having a top wall, a bottom wall, a pair of opposed side walls, a back wall, and a vertical flange on the front for containing items which may be viewed at the front side of the housing.

The top end of the flange is spaced from the top wall to provide space for inserting the items into the housing above the flange. The bottom end of the flange is spaced from the bottom wall to provide space for exit of the items at the bottom of the housing below the flange. An asymmetrical removable lip installed at the bottom of the flange may be reversed top to bottom to change the height of the exit opening at the bottom of the housing.

A straight, springy, vertical backstop may be positioned by way of notches in the top wall and bottom wall of the housing to set the front-to-back internal size of the housing for holding the items stacked in the housing. The bottom of the springy backstop has a forward and downward inclined straight portion of about half the height of the exit opening so that the lowermost one of the items stacked in the housing is ramped forward beyond the backstop, with the front of the item extending free from the front of the housing when it falls to rest on the bottom wall of the housing.

U.S. Pat. No. 4,769,573, patented Sep. 6, 1988 by M. Celik, describes a vertical transparent housing having a front wall, a back wall, a pair of opposed side walls, and a bottom wall. The top of the housing is open for directly vertically receiving and stacking tape cassettes, each cassette being horizontal, within the closely fitting walls.

An exit slot the height of a cassette is provided at the bottom of the front wall.

To provide space for fingers to grasp a cassette for removing it from the housing, a portion of each sidewall adjacent to the slot is removed, and the portion of the bottom wall that is below the slot is made narrower than a cassette. A central region of the bottom wall is slightly raised to space the cassette above the bottom wall for easier grip of the cassette.

U.S. Pat. No. 5,295,592, patented Mar. 22, 1994 by R. Thorne, describes a vertical housing for stacking and dispensing horizontal articles stacked within closely fitting walls of the housing.

A downward and forward inclined straight wall has a bottom stop that traverses an exit opening in the bottom of the front wall of the housing for withdrawing items. The inclined wall has sufficient length to hold two items in tandem within the housing, so that the back end of the uppermost item, in cooperation with a springy catch on a side wall of the housing, supports the lowest item of a superimposed stack of the horizontal items by contacting the general center of the stacked item.

When the lowermost of the two items on the inclined wall is removed from the housing, the inclined item above slides down. As the support from the inclined item moves down, the lowermost stacked item follows, the side of the lowermost stacked item that is distal from the springy catch sliding down under its own weight against a vertical side wall of the housing while the other side of the lowermost stacked item which is resting on the springy catch forces the catch outward until the item slips from the catch and rests in tandem on the inclined wall behind the lowermost inclined item.

U.S. Pat. No. 5,368,191, patented Nov. 29, 1994 by A. Johnson, describes a vertical housing having a delivery opening at the bottom for withdrawing the bottom-most item of a plurality of items stacked in the housing.

The bottom-most item rests on an item support wall at the bottom of the housing. The item support wall is a downward and forward inclined straight wall which extends beyond the front wall of the housing and which is flanked by guide walls for holding the item being dispensed at an angle suitable for displaying the top of the item.

The penultimate item in the stack is supported at the back lower edge by the inclined straight wall and on the forward bottom by the upper back edge of the item being dispensed. This support tilts and shifts the penultimate item forward, the limit of forward shift being set by contact of the top edge of the front of the penultimate item with a downward and forward depending tab or retainer means which extends from the front wall from the top of the delivery opening.

SUMMARY OF THE INVENTION

It is one object of the invention to provide a dispenser which displays the items which are in the dispenser.

It is another object to provide a dispenser which loads from the front of the dispenser.

It is another object to provide a dispenser which redirects movement of an item being loaded from a rearward direction to a forward direction, and guides the item to a delivery shelf.

It is another object that the redirection of movement of the item guides the item for stacking in the dispenser.

It is another object that the impact of receiving of the item on the delivery shelf is shock absorbed.

Other objects and advantages of the invention will become apparent to persons skilled in the art from the ensuing description.

A method for guiding a plurality of articles of approximately the same size through an upper part of a dispenser for storing and dispensing articles from a lower part of the dispenser includes inserting a first end of a first article through a loading opening in the front of the dispenser, supporting the first end of the article on first shelf means adjacent to and behind the loading opening, moving the article rearward over the first shelf means until the first end of the article moves off the first shelf means over a fall space and then contacts the top of a second shelf means while the second end of the article is on the first shelf means.

This may include supporting the first end of the article on the second shelf means at approximately the same height as the first shelf means.

The method also includes moving the first end of the article rearward until the second end of the article passes over an end of the first shelf means into the fall space so that the article slides forward and pivots over an end of the second shelf and the second end of the article falls within the fall space.

The method also includes receiving the second end of the article and the first end of the article on a downward and forward sloping wall and supporting the second end of the article on the downward and forward sloping wall forward of the front vertical wall of the dispenser.

The second end of a second article moved through the dispenser is supported by the first article and the front of the dispenser so that the first end of the second article extends rearward of the first end of the first article.

A dispenser for articles having a storage zone for a plurality of articles includes an opening in the front of the dispenser generally above the storage zone for loading articles into the dispenser, first support means in the dispenser mounted on the dispenser adjacent to the opening, and second support means in the dispenser mounted on the dispenser generally at the height of the first support means and spaced from the first support means so that an article that is supported at a first end and a second end of the article by the second support means and the first support means respectively simultaneously can pass down between the first and said second support means when the article is not supported by the first support means.

The first support means includes means for holding an article by one end so that the article cannot fall between the first and second support means.

The dispenser also includes a first wall, that is downward and forward sloping and is mounted in the dispenser below the storage zone so that an article which falls between the first and second support means lands on the first wall. The first wall includes a flexible portion positioned so that said first wall receives the first end of the article that passes down between the first and second support means first at the flexible portion.

The flexible portion is preferably generally straight and extends forward of the opening in the front of the dispenser.

The first wall includes a stiff portion, and is generally curvilinear.

The first wall also includes a longitudinal article support rib, and an elongated opening through the first wall. The elongated opening extends a substantial length of the height of said first wall.

BRIEF DESCRIPTION OF THE DRAWINGS

In order that the invention be more fully comprehended, it will now be described, by way of example, with reference to the accompanying drawings, in which.

Figure 1:
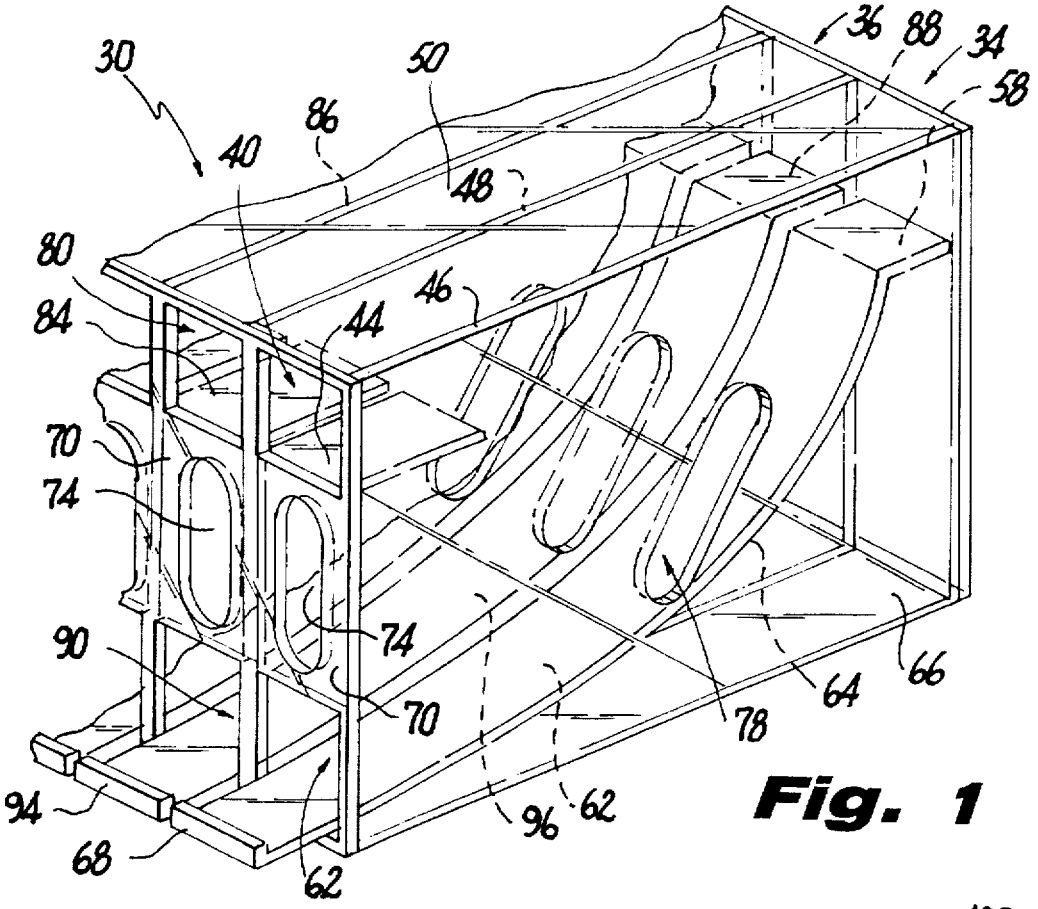
FIG. 1 is a perspective view of an article dispenser of the present invention, showing two adjacent dispenser modules.

FIG; 14 is a cross section top view of a dispenser of the invention.

DESCRIPTION OF THE PREFERRED EMBODIMENTS

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, dispenser 30 comprises modules 34 and 36 which are designed to dispense the same size articles, for example individually packaged lipsticks in which both ends of each of the packages are marked with the color of the lipstick therein.

To load dispenser module 34, an article is inserted into the dispenser by way of loading opening 40. The article is supported on shelf 44 and guided in the dispenser by side walls 46 and 48 and top wall 50. The article is moved so that it is also supported on shelf 58, then moved off shelf 44 so that the article rotates down from shelf 58 and falls onto delivery portion 62 and curvilinear portion 64 of wall 66 where it moves down through delivery opening 72 to stop 68 for gripping and removing from the dispenser by a user. Front wall 70 is transparent for viewing the ends of the articles in the dispenser, and has openings 74 for reaching the articles therein to correct possible jambs. Wall 66 has opening 78 for reaching the articles. For example, a wrapper may come undone in the dispenser and have to be urged through with outside help. Under normal circumstances, guide wall 66 and gravity provide sufficient thrust to move an article from shelf 58 to stop 68.

Dispenser module 36 is similar to dispenser module 34. An article that is inserted through loading opening 80 is supported on shelf 84 and guided in the dispenser by side walls 48 and 86, and top wall 50. It is moved to shelf 88, delivery portion 90, curvilinear portion 92, on the way to stop 94.

Figure 2:
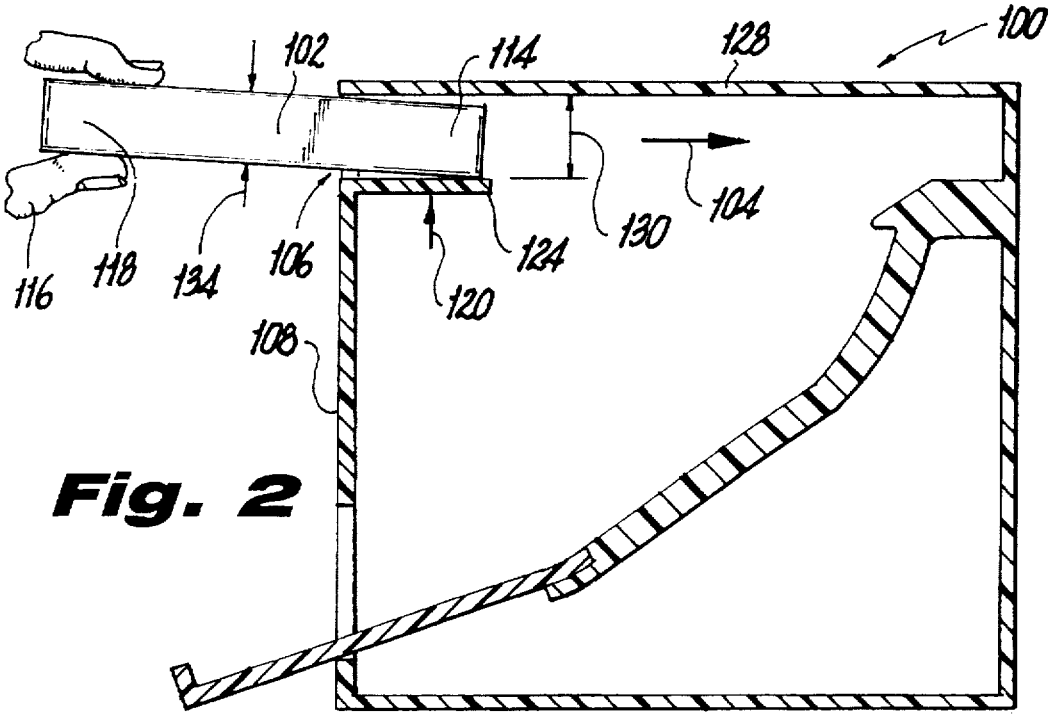
FIG. 2 is a side elevation schematic of another article dispenser of the invention showing a user inserting an article into the dispenser.

Referring to FIGS. 2–10, Dispenser 100 is loaded with articles and dispenses them as follows:

In FIG. 2, article 102 is inserted rearward as shown by direction arrow 104, into loading opening 106 in front wall 108 of dispenser 100. End 114 is inserted first, by user 116 gripping end 118 of the article.

End 114 is supported upward 120 by rearward extending, generally horizontal, shelf 124 which is mounted on wall 108 adjacent to and behind loading opening 106.

Upward movement of article 102 is restricted by wall 128, so that if the operator were to let go of the article, it would be held generally horizontal by shelf 124 and wall 128, as wall 128 is spaced 130 from and above shelf 124 closely to height 134 of article 102.

Figure 3:
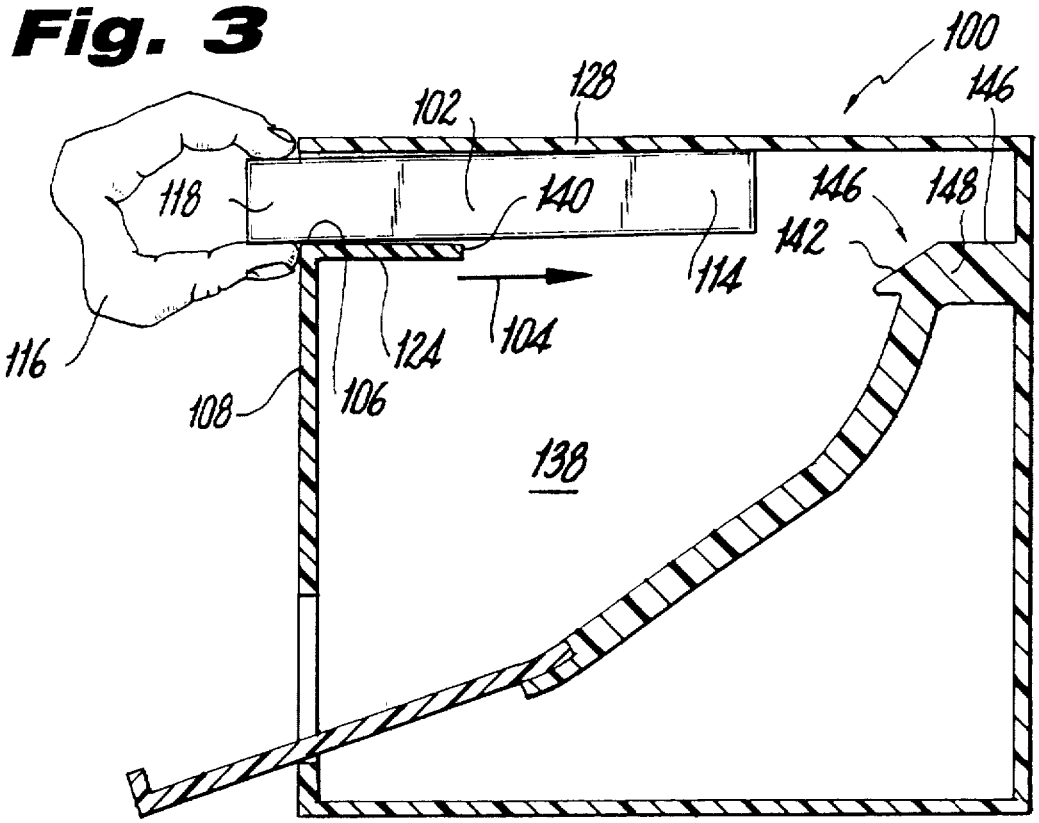
FIG. 3 is a side elevation schematic view of the dispenser of FIG. 2, with the article being moved in the dispenser by the user.

In FIG. 3, article 102 is moved rearward. Although end 114 is not supported by shelf 124 because it has moved off shelf 124 over fall space 138, end 114 does not fall in fall space 138 because wall 128 prevents end 118 from moving upward preventing item 102 from pivoting at the rear end 140 of shelf 124.

Figure 4:
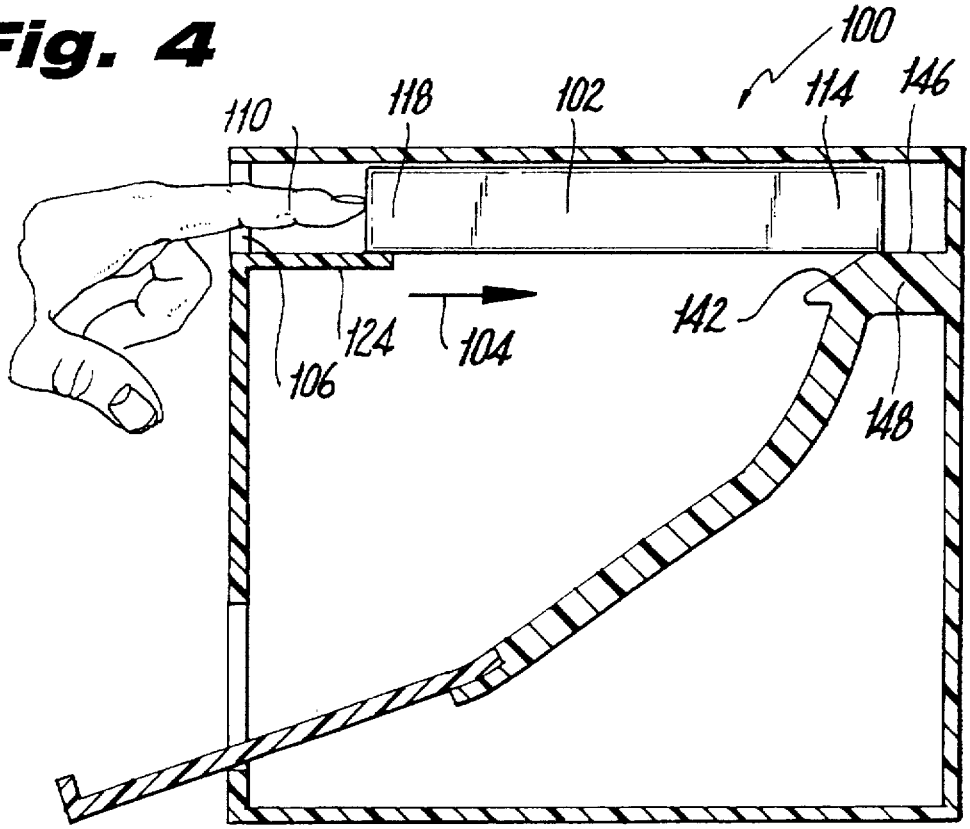
FIG. 4 is a side elevation schematic view of the dispenser of FIG. 2, with the article being moved in the dispenser by the user.

In FIG. 4, article 102 is moved rearward 104 under the urging of the users finger 110 which is extended into loading opening 106 over shelf 124 until end 114 of article 102 contacts cam surface 142 of top 146 of shelf 148.

Figure 5:
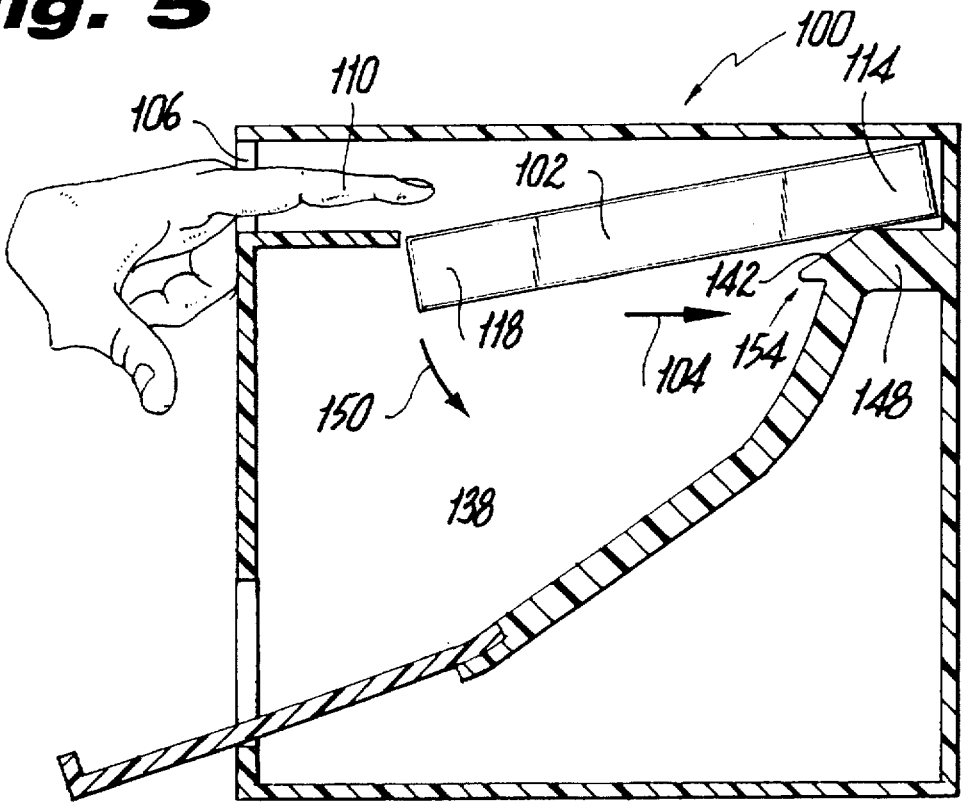
FIG. 5 is a side elevation schematic view of the dispenser of FIG. 2, with the article being guided within.

In FIG. 5, article 102 is moved rearward 104 under urging of the users finger 110 extending into loading opening 106 over shelf 124. Article 102 end 114 moves rearward over shelf 148 at about the same height as shelf 124 until end 118 passes over rear end 140 of shelf 124 and down 150 fall space 138.

Figure 6:
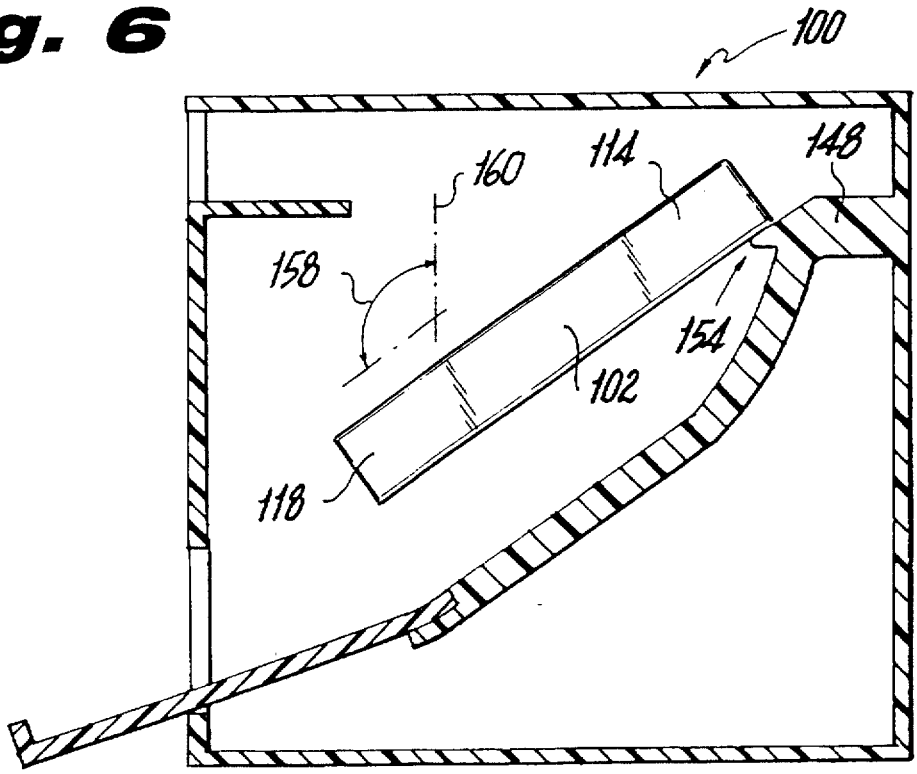
FIG. 6 is a side elevation schematic view of the dispenser of FIG. 2, with the article being guided within.

In FIG. 6, article 102 end 118 falls in fall space 138 as end 114 pivots on and slides forward over forward end 154 of shelf 148. End 118 falls in fall space 138 before end 114 falls in the fall space so that article 102 has a forward and downward angle 158 or attitude with respect to plumb vertical 160.

Figure 7:
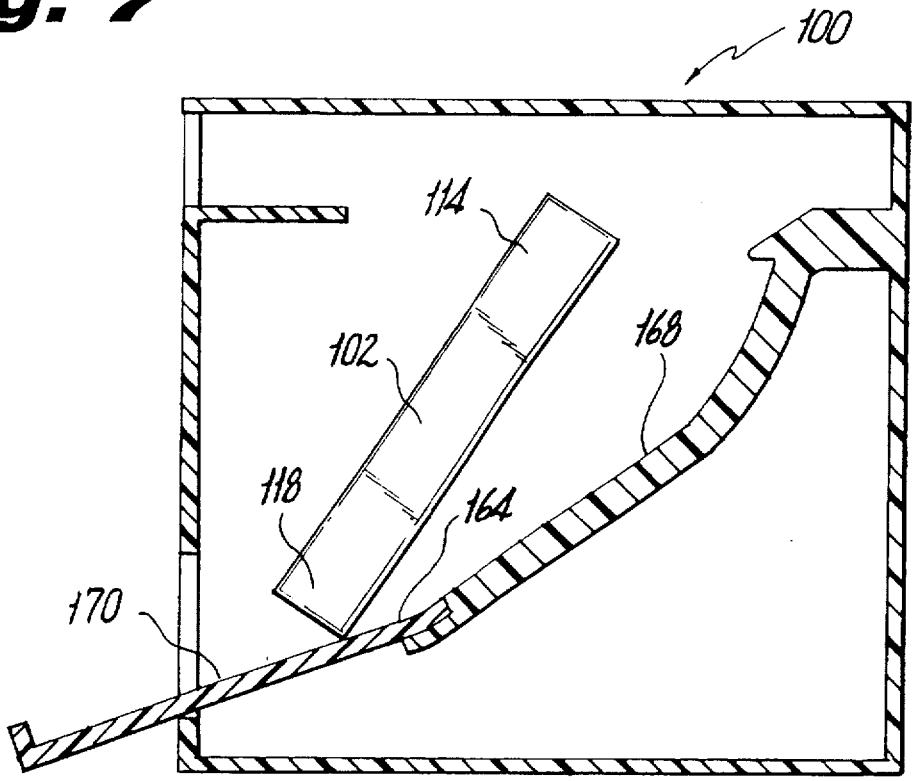
FIG. 7 is a side elevation schematic view of the dispenser of FIG. 2, with the article being guided within.

In FIG. 7, falling end 118 of article 102 is received by downward and forward sloping wall 164. Preferably wall 164 includes a smooth, curvilinear article support section 168 at the rear of the wall, and a straight article support section 170 at the front of the wall.

Preferably section 168 is stiff and adapted for holding the weight of a plurality of stacked articles, and section 170 is flexible so that it absorbs the shock of impact of receiving a falling article.

Figure 8:
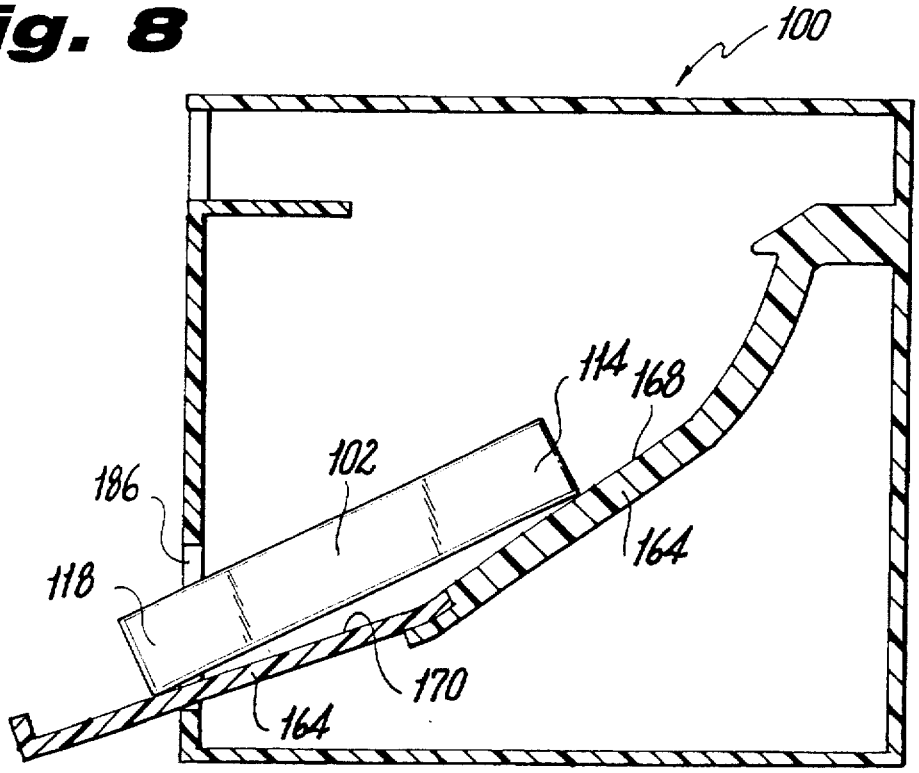
FIG. 8 is a side elevation schematic view of the dispenser of FIG. 2, with the article being guided within.

In FIG. 8, end 114 of article 102 is received by downward and forward sloping wall 164, and article 102 slides through delivery opening 186.

Figure 9:
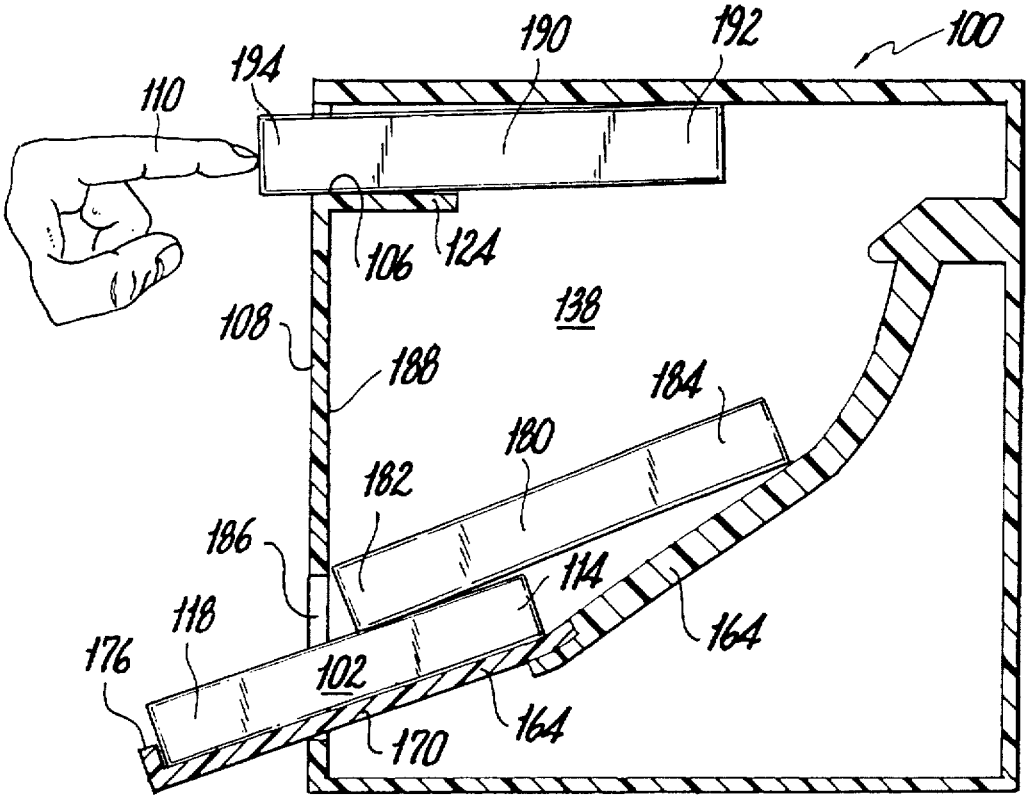
FIG. 9 is a side elevation schematic view of the dispenser of FIG. 2, with another article being inserted by the user, and with an additional article being guiding within.

In FIG. 9, section 170 of wall 164 supports end 118 forward of wall 108. The forward and downward slope of wall 164 moves article 102 under the influence of gravity to stop 176.

End 182 of article 180 rests on article 102 and against the back 188 of wall 108 above opening 186. End 184 rests on article support section 168, and extends rearward of end 114.

Article 190 is inserted through opening 106 on shelf 124 of the dispenser. End 194 is being urged rearward by user's finger 110. End 192 extends over fall space 138.

Figure 10:
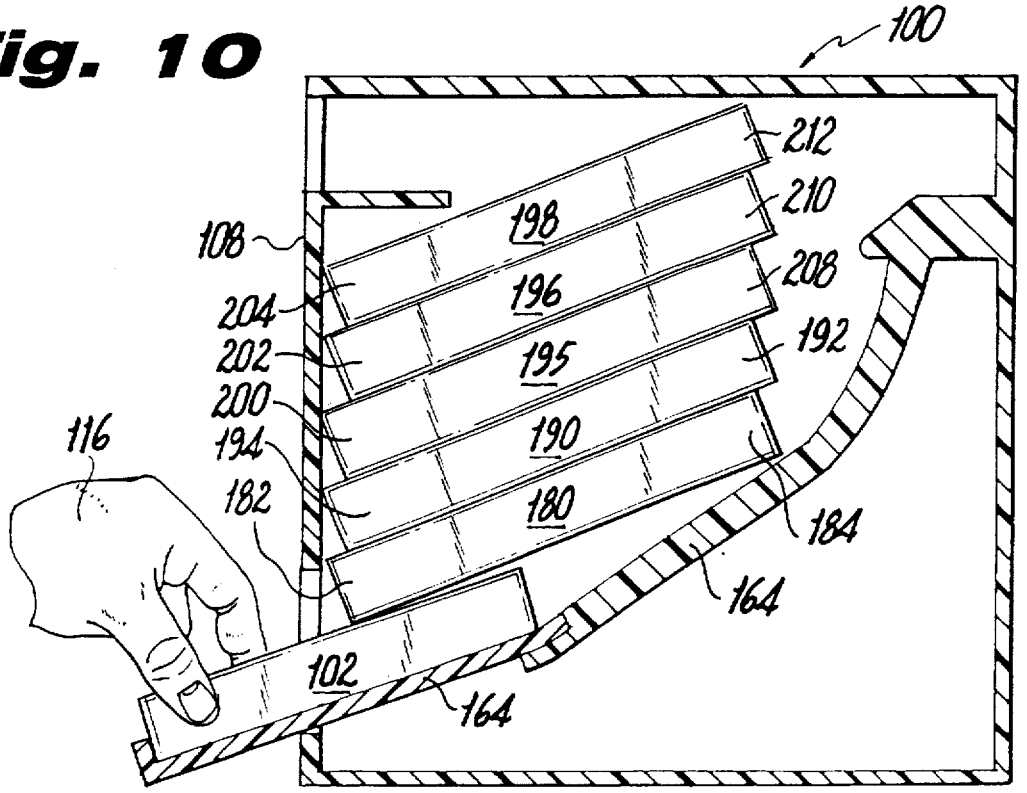
FIG. 10 is a side elevation schematic view of the dispenser of FIG. 2, fully loaded with articles, dispensing an article.

In FIG. 10, dispenser 100 is fully loaded with articles 102, 180, 190, 195, 196 and 198, each sloped forward and downward and all but the article 102 being parallel with one another. Ends 182, 194, 200, 202, and 204 rest against front wall 108, and each on the article below. Ends 192, 208, 210, and 212 each extend rearward of the rearward end of the article below.

User 116 is removing article 102 from wall 164.

Figure 11:
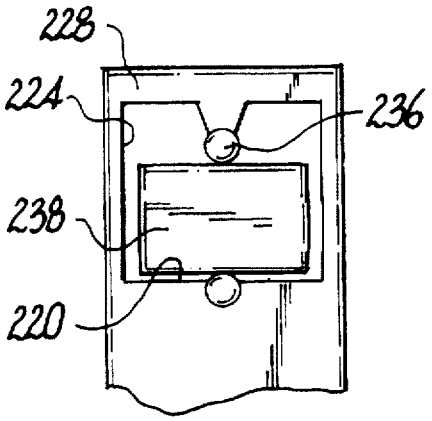
FIG. 11 is a rear view of a loading opening of a dispenser of the invention with an article supported adjacent to the opening.

In FIG. 11, shelf 220 adjacent to loading opening 224 in front wall 228 of a dispenser of the invention is a horizontal rod extending from wall 228. Horizontal rod 236 keeps article 238 from rising from shelf 220.

Figure 12:
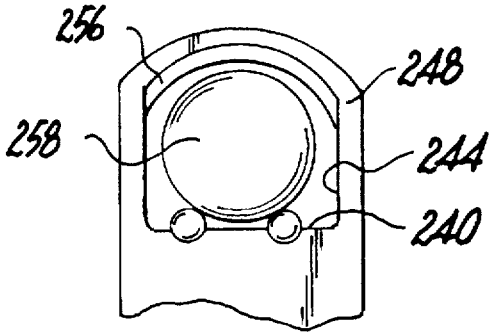
FIG. 12 is a rear view of a loading opening of a dispenser of the invention with an article supported adjacent to the opening.

In FIG. 12, shelf 240 adjacent to loading opening 244 in front wall 248 of a dispenser of the invention is a pair of horizontal rods extending from wall 248. Curved wall 256 extending horizontally from wall 248 prevents article 258 from rising from shelf 240.

Figure 13:
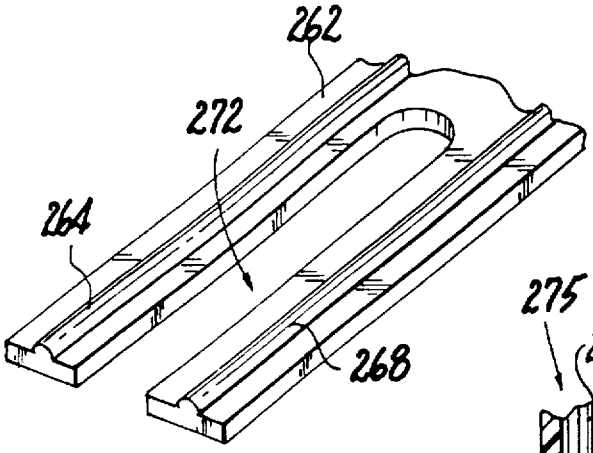
FIG. 13 is a perspective view of an article support wall of a dispenser of the invention.

In FIG. 13, downward and forward sloped wall 262 of another dispenser of the invention includes longitudinal raised ribs 264 and 268 which support an article that is supported by the wall in the region of longitudinal opening or slot 272 in the wall.

Figure 14:
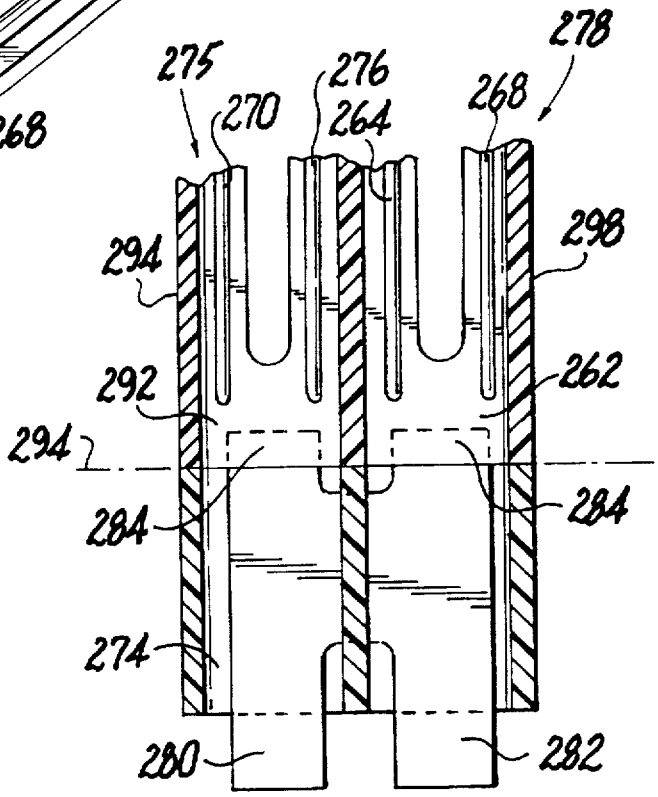

In FIG. 14, walls 262 and 292 are similar. They are stiff, have curvilinear article support ribs 264, 268, 270, and 276, and are supported by vertical walls 294 and 296 of module 275 and vertical walls 296 and 298 of module 278. Wall 296 separates the modules. Walls 294, 296, and 298 connect to bottom wall 274.

Flexible straight walls 280 and 282 are bonded 284 by suitable means to walls 262 and 292, and are connected through wall 296 for combined flex strength and for horizontal stability.

Assembly can be made in three sections by molding the bulk of the dispenser, but for walls 280/282, in a front and a back half along line 294, then bonding walls 280/282 to walls 262/292, and then bringing the front and back sections together in abutting relationship and bonding the sections together.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A method for guiding a plurality of articles of approximately the same size through an upper part of a dispenser for storing and dispensing articles from a lower part of the dispenser, said articles each having a longitudinal dimension, a width and a pair of ends, each end of the pair having substantially the same width as each other end, said method comprising the steps of:

inserting a first end of a first of the articles through a loading opening in the front of the dispenser, supporting the first end of the article on first shelf means adjacent to and behind the loading opening, moving the article rearward over the first shelf means until the first end of the article moves off the first shelf means over a fall space and then contacts the top of a second shelf means while the second end of the article is on the first shelf means, moving the first end of the article rearward over the second shelf means until the second end of the article passes over an end of the first shelf means into the fall space so that the article slides forward and pivots over an end of the second shelf and the second end of the article falls within the fall space with the longitudinal dimension angle substantially less that 90° from horizontal.

2. The method of claim 1, further comprising:

receiving the second end of the article on a downward and forward sloping wall.

3. The method of claim 2, further comprising:

after the step of claim 2, receiving the first end of the article on the downward and forward sloping wall.

4. The method of claim 3, further comprising:

supporting the second end of the article on the downward and frontward sloping wall forward of the front wall of the dispenser.

5. The method of claim 2, further comprising:

inserting a first end of a second of the articles through the loading opening, supporting the first end of the second article on said first shelf means by a generally horizontally rearward extending surface, restricting upward movement of the second article by a third shelf means spaced from and above said first shelf means closely to the height of the article to be dispensed.

moving the second article rearward over the first shelf means until the first end of the second article moves off the first shelf means over the fall space and then contacts the top of the second shelf means while the second end of the second article is on the first shelf means.

moving the first end of the second article rearward over the second shelf means until the second end of the second article passes over an end of the first shelf means into the fall space so that the second article slides forward and pivots over an end of the second shelf and the second end of the second article falls within the fall space.

6. The method of claim 5, further comprising:

after the steps of claim 5, supporting the second end of the second article by said first article and the front of the dispenser so that the first end of the second article extends rearward of the first end of the first article.

7. The method of claim 1, further comprising:

supporting the first end of the article on the second shelf means at approximately the same height as the first shelf means.

8. The method of claim 7, further comprising:

moving the first end of the article rearward over the second shelf means until the second end of the article passes over a rearward end of the first shelf means into the fall space so that the article slides forward and pivots over an end of the second shelf and the second end of the article falls within the fall space.

9. The method of claim 8, further comprising:

receiving the second end of the article on a downward and forward sloping wall.

10. The method of claim 1, further comprising:

restrictive upward movement of the article from the first shelf means.

moving the first end of the article rearward over the second shelf means until the second end of the article passes over an end of the first shelf means into the fall space so that the article slides forward and pivots over an end of the second shelf and the second end of the article falls within the fall space, and receiving the second end of the article on a downward and forward sloping wall.

11. The method of claim 1, further comprising:

moving the first end of the article rearward over the second shelf means until the second end of the article passes over an end of the first shelf means into the fall space so that the article slides forward and pivots over an end of the second shelf and the second end of the article falls within the fall space, and receiving the second end of the article on a downward and forward sloping flexible wall.

12. A dispenser for articles, each article having a longitudinal dimension, said dispenser having a front, a back, a top, a bottom, and a storage zone for a plurality of articles, said dispenser comprising:

an opening in the front of said dispenser generally above the storage zone for loading articles into the dispenser, first support means in said dispenser, mounted on said dispenser adjacent to said opening, second support means in said dispenser mounted on said dispenser generally at the height of said first support means and spaced from said first support means so that an article that is supported at a first end and a second end of said article by said second support means and said first support means respectively simultaneously, can pass down between said first and said second support means when said article is not supported by said first support means;

said first support means comprising means for holding an article by one end so that the article cannot fall between the first and second support means;

said second support means being further for orienting the longitudinal dimension less than 90° from horizontal;

a first wall, being downward and forward sloping and being mounted in said dispenser below said storage zone so that an article which falls between the first and second support means lands on said first wall.

13. The dispenser of claim 12, further comprising:

said first wall comprising a flexible portion positioned so that said first wall receives the first end of the article that passes down between said first and second support means first at said flexible portion.

14. A dispenser for articles, said dispenser having a front, a back, a top, a bottom, and a storage zone for a plurality of articles, said dispenser comprising:

an opening in the front of said dispenser generally above the storage zone for loading articles into the dispenser, first support means in said dispenser, mounted on said dispenser adjacent to said opening, second support means in said dispenser mounted on said dispenser generally at the height of said first support means and spaced from said first support means so that an article that is supported at a first end and a second end of said article by said second support means and said first support means respectively simultaneously, can pass down between said first and said second support means when said article is not supported by said first support means;

a first wall, being downward and forward sloping and being mounted in said dispenser below said storage zone so that an article which falls between the first and second support means lands on said first wall;

said first wall comprising a flexible portion positioned so that said first wall receives the first end of the article that passes down between said first and second support means first at said flexible portion;

said flexible portion being generally straight and extending forward of the opening in the front of said dispenser.

15. The dispenser of claim 14, further comprising:

said first wall comprising a stiff portion, and being generally curvilinear.

16. The dispenser of claim 12, further comprising:

said first wall comprising a flexible portion positioned so that said first wall receives the first end of the article that passes down between said first and second support means first at said flexible portion.

17. A dispenser for articles, said dispenser having a front, a back, a top, a bottom, and a storage zone for a plurality of articles, said dispenser comprising:

an opening in the front of said dispenser generally above the storage zone for loading articles into the dispenser, first support means in said dispenser, mounted on said dispenser adjacent to said opening, second support means in said dispenser mounted on said dispenser generally at the height of said first support means and spaced from said first support means so that an article that is supported at a first end and a second end of said article by said second support means and said first support means respectively simultaneously, can pass down between said first and said second support means when said article is not supported by said first support means;

a first wall, being downward and forward sloping and being mounted in said dispenser below said storage zone so that an article which falls between the first and second support means lands on said first wall;

said first wall comprising an elongated opening through said first wall, said elongated opening extending a substantial length of the height of said first wall;

a longitudinal article support rib on said first wall.

* * * * *